US005553784A

United States Patent [19]

Theurer

[11] Patent Number: 5,553,784

[45] Date of Patent: Sep. 10, 1996

[54] DISTRIBUTED ARRAY MULTIPOINT NOZZLE

[75] Inventor: Werner Theurer, Lebanon, N.J.

[73] Assignee: Hago Industrial Corp., Mountainside, N.J.

[21] Appl. No.: 353,188

[22] Filed: Dec. 9, 1994

[51] Int. Cl.[6] ..... B05B 7/10

[52] U.S. Cl. ..... 239/403; 239/432

[58] Field of Search ..... 239/403, 404, 239/405, 432, 434.5

[56] References Cited

U.S. PATENT DOCUMENTS

| | | | |
|---|---|---|---|
| 1,087,767 | 2/1914 | Hoffman | 239/104 |
| 1,898,763 | 2/1933 | Lowardon et al. | 239/403 X |
| 2,313,298 | 3/1943 | Martin et al. | 239/404 X |
| 2,419,365 | 4/1947 | Nagel | 239/403 X |
| 2,566,040 | 8/1951 | Simmons | 239/403 X |
| 2,595,759 | 5/1952 | Buckland | 239/403 |
| 3,747,851 | 7/1973 | Conrad | 239/8 |

OTHER PUBLICATIONS

Brochure on "Air Atomizing Nozzles", pp. 35–45; Page 10 of brochure titled Air Operated Industrial Oil Burner Nozzles.

*Primary Examiner*—Kevin Weldon

[57] ABSTRACT

A nozzle assembly provides a high pressure dispersion of water particles in a misting process. The nozzle includes multiple arrayed discharge outlets into a single mixing zone wherein the discharge outlets are concentrically arranged alternating between water and gas streams. The mist from the novel arrangement is highly dispersed, providing excellent gas cooling operation with minimal maintenance.

14 Claims, 5 Drawing Sheets

DISTRIBUTED ARRAY MULTIPOINT NOZZLE

The present invention relates generally to the design of two-phase nozzles and, more particularly, nozzles for developing a finely divided mist of water using air as a propellant.

BACKGROUND OF THE INVENTION

Brief Description of the Prior Art

Due to enormous number of diverse applications, nozzle design is a fairly mature area of development with a wide variety of arrangements that have evolved over the years. Recently, sophisticated design techniques employing the latest test equipment and arcane mathematical algorithms for fluid dynamic modeling have imparted a new approach to nozzle design. Notwithstanding this design approach, the complexity of the system defies effective mathematical modeling and the design of nozzles remains more art than science—with heavy reliance on trial and error for advancing and fine tuning any given approach. Often the expected successful design fails while inexplicably simple variations thereof succeed.

Nozzles are used in different ways for different purposes; but all have in common the release of a high pressure fluid into a lower pressure environment. Of particular interest in the present discussion is the use of nozzles to provide a finely divided mist of water, i.e., in droplet form where the individual droplets are very small and uniform. The use of finely divided water droplets are of significant commercial value in gas cooling towers where a high temperature gas (2000° Fahrenheit) must be rapidly cooled to approximately 200°. Introducing a finely divided mist of water droplets into the gas stream causes the water to evaporate—almost instantaneously—soaking up heat energy via the phase change in the process and reducing the gas stream temperature dramatically.

However, gas cooling with a water droplet stream that comprises relatively large droplets creates secondary problems. The large droplets take significantly longer to evaporate and many simply don't. These residual droplets collect dust and other particulate matter in the gas stream and coalesce on the tower wall or floor, creating deposits that require separate cleaning and disposal. This maintenance can become a significant expense in the overall economics of the cooling process.

Most misting nozzles for gas cooling employ air as a propellant to the water, to increase discharge velocity and provide for enhanced disbursement of the individual droplets as formed. Air is supplied at about the same pressure as the water, and thus, must be pressurized via air compressors or similar—equipment that is both capital intensive per unit capacity and energy intensive. This leads to fairly high operating costs per unit capacity. Air is otherwise not an important component of the system, and thus, it is often a critical design criteria for nozzle designers to develop systems that minimize the amount of air required without diminished performance.

Another important aspect of the use of nozzles in gas cooling relates to their expected lifespan. Many gas cooling towers exist in a highly abrasive and/or corrosive environment as sulfuric acid and other corrosive gases invariably come in contact with the nozzles. To extend the life of the nozzles, the materials of construction will include specialized metals (e.g., hastalloys) or ceramics. These materials extend life and thus reduce maintenance, but are difficult to precisely machine. Moreover, the nozzles themselves must be disconnected, inspected and reinstalled to insure good long term performance. This inspection work is done in a nasty plant environment by semi-skilled personnel, with the potential for faulty reinstallation of the nozzle and ancillary equipment. Nozzle design, therefore, must consider the limitations associated in machining certain materials implicated by such environments and further provide a design that is easy to install without error or misconnection.

It was with the above understanding that the present invention was made.

OBJECTS AND SUMMARY OF THE PRESENT INVENTION

It is an object of the present invention to provide a nozzle system that provides a finely divided mist spray with a low volume of propellant.

It is another object of the present invention to provide a nozzle system that provides interchangeable fluid inlet connections without disturbing the performance of the nozzle in its intended application.

It is a further object of the present invention to provide a nozzle design that is manufactured in a reduced amount of time and with a reduced number of machining steps.

It is a further object of the present invention to provide a nozzle design that is machinable out of difficult to machine materials of construction.

The above and other objects of the present invention are realized in a nozzle design that provides two interchangeable inlet lines, one for the propellant air and the other for the liquid phase—water. The inlet lines separately feed a distributed angled array of turbulent zone feeders with the array of feeders alternating in feed stream source between water and air. The turbulent zone extends forward towards an extended constriction zone, which is followed by an outlet flair and an impact dispersing plate. Air and water are concurrently fed to the inlet lines at about the same line pressure. The distributed array of inlets introduce the air and water into the turbulent mixing zone in a controlled alternating vortex creating a homogenized two-phase fluid stream. The two-phase stream travels outward through the constriction zone, out the nozzle exit and against the dispersion plate, causing the intermixed stream to rapidly accelerate and break up into a finely divided mist of droplets having a narrow particle size distribution and a mean diameter in the micron size range.

In accordance with the varying aspects of the present invention, the nozzle is manufactured by the separate and enhanced construction of five individual subcomponents. The selected arrangement of subcomponents allows flexibility in the selection of materials of construction, including the use of materials that are amenable to precision surface machining while exhibiting a long operative lifespan.

The foregoing invention can be more completely appreciated in the context of a specific illustrative example presented in conjunction with the following detailed drawings of which:

DETAILED DESCRIPTION OF THE PREFERRED EMBODIMENTS

First briefly in overview, the present invention is directed to a unique nozzle design that provides for controlled angled infusion of a gas and water stream, followed by rapid acceleration in a constriction zone and then pressure drop and release against the impact disc. The foregoing two-phase stream and its specific path through the several arteries of the nozzle provide a highly dispersed mist of water droplets in a controlled manner. Moreover, the arrangement of the stream path within the specific subcomponents provides for an arrangement of parts that can be economically machined or cast as determined by the materials needed for the application.

Figure 1:
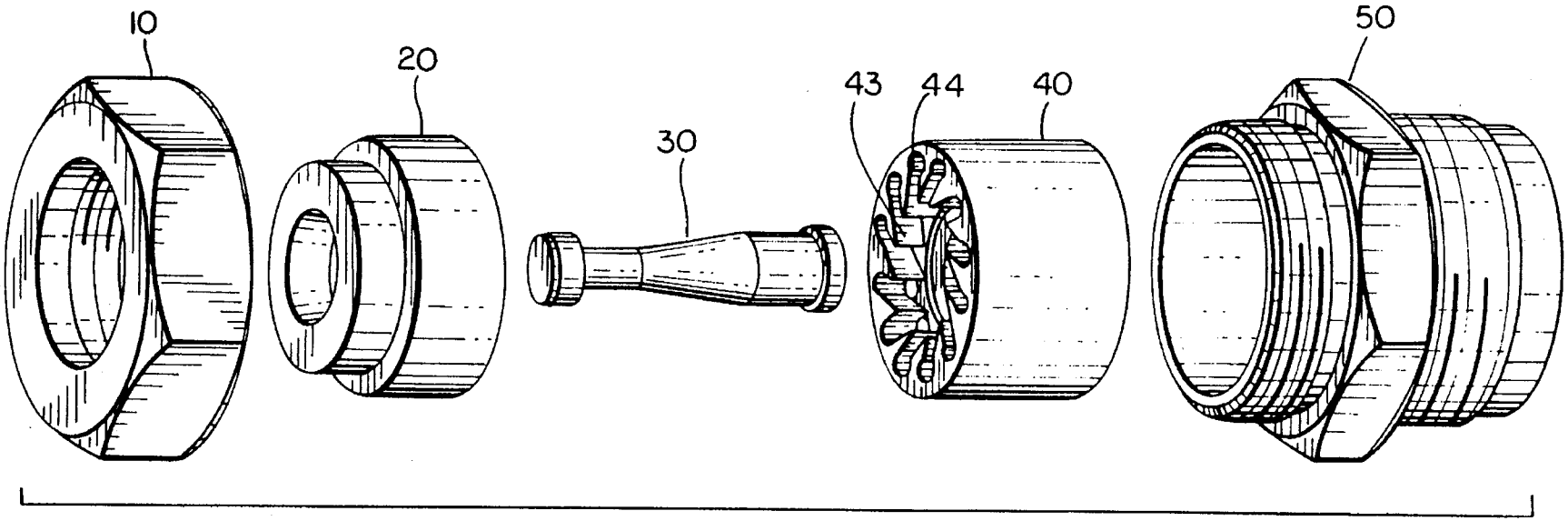
FIG. 1 is a first isometric presentation of the five key components comprising the inventive nozzle.

With the above brief overview in mind, attention is first directed to FIG. 1 presenting all five elements of the present nozzle invention in an "exploded" view to give appreciation to their in seratum spatial relationship. Going left to right (nozzle outlet to inlet), nozzle cap 10 encloses nozzle orifice 20. Pintel 30 extends through the orifice 20 and mixing disc 40. Mixing disc 40 is contained by nozzle housing 50 which has threaded connection to cap 10 to complete the enclosure. In a manner that will be explained in more detail below, mixing disc 40 provides an array of angled outlets for alternating gas 43 and water 44 infusion into the constriction zone defined by orifice 20 and the sloped surface of pintel 30.

Figure 2:
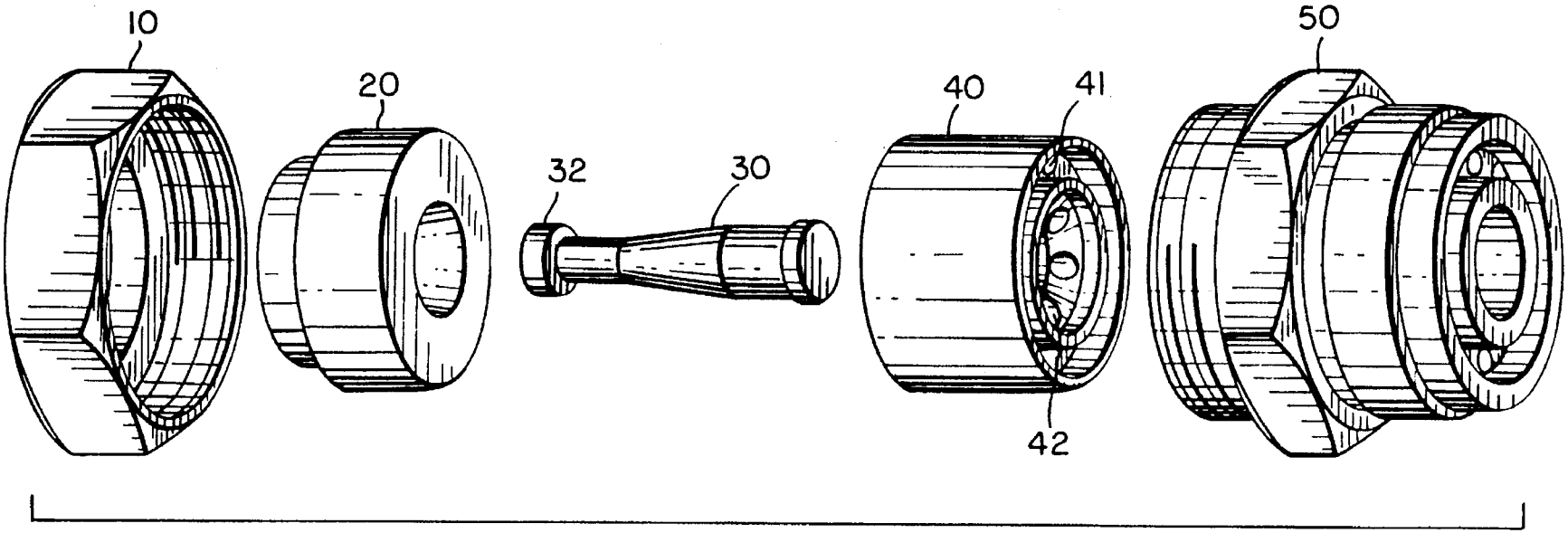
FIG. 2 is a second isometric presentation of the five key components comprising the inventive nozzle structure.

FIG. 2 provides essentially the same presentation of FIG. 1, differing only in the vantage of the view. In FIG. 2, the inlet to the mixing disc 40 is shown as two concentric rings of openings—and specifically outer openings 41 and inner openings 42. These openings represent the inlets for both the gas and water phase, feeding the alternating angled outlets depicted in FIG. 1.

Figure 3:
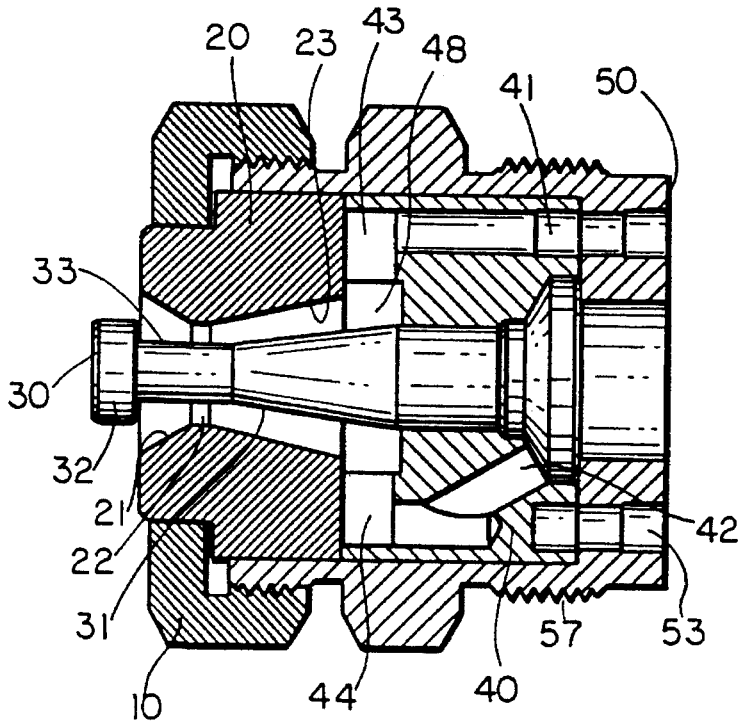
FIG. 3 is an assembly drawing for the five components of FIGS. 1 and 2.

Turning now to FIG. 3, the separate subcomponents of the previous figures are depicted in assembled relationship. Going from right to left, housing 50 includes concentric inlets 53 and 54 for the gas and water stream connections. Importantly, there is no system requirements regarding whether the gas stream is connected to the inner openings 54 or the outer openings 53. This removes the very critical potential area for operator error found in prior art nozzle designs, as the operator can connect the water and gas lines to either 53 or 54.

Continuing with FIG. 3, mixing disc 40 precisely sits in housing 50 bringing the inlets 54 in communication with openings 42 and inlets 53 in communication with openings 41, respectively. As can be seen in this cross-section, cut-away view, openings 41 connect to a first series of angled outlets 43, while the openings 42 lead to the second series of angled outlets 44. Angled outlets 43 and 44 are arranged in a planer circular alternating array feeding a first mixing zone 48, defined by pintel 30 having an inclined cylindrical surface 31 and the orifice 20 having a first inner surface 23 defining a fairly steep incline to form a first constriction zone, followed by a flat surface 22, and then extending into an expanded nozzle opening zone defined by orifice inner surface 23; the nozzle opening terminates with impact plate 32. The angled outlets are preferably angled off center to about 25°. The subcomponents are held in position by cap 10 with threaded engagement with housing 50.

Figure 4A:
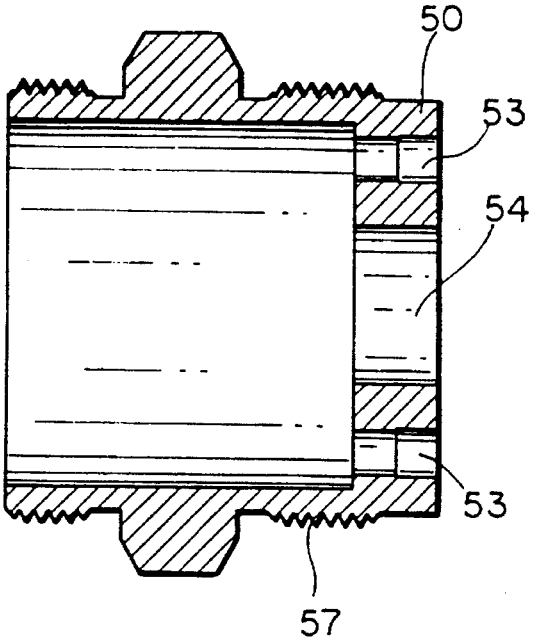
FIG. 4A is a cross-sectional view of the nozzle housing.
Figure 4B:
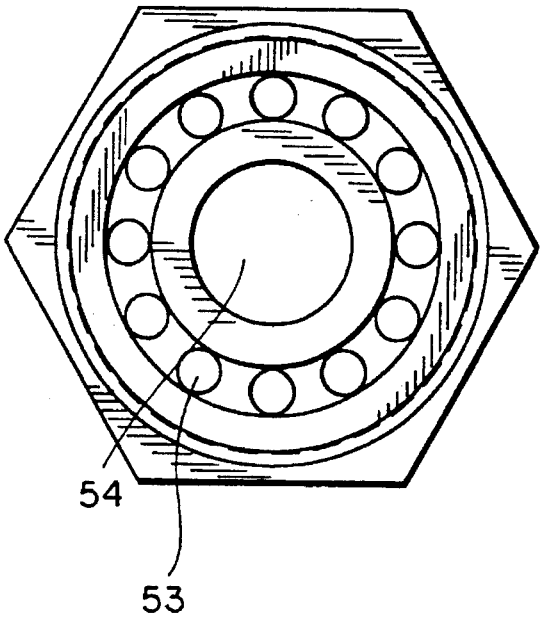
FIG. 4B is a frontal view of the nozzle housing.

The housing 50 is depicted in end and side views in FIGS. 4A and 4B. Inlets 53 and 54, respectively, are provided in outer and inner concentric rings of housing 50, which further provides a threaded outer region 57 for connection to cap 10.

Figure 5C:
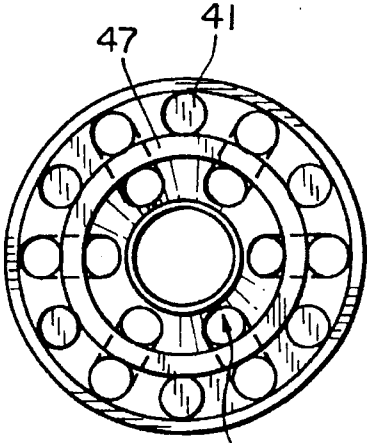
FIG. 5C is a back-end view of the mixing disc.
Figure 5B:
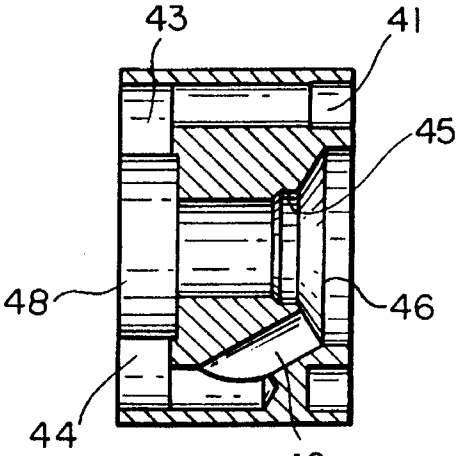
FIG. 5B is a cross-sectional view of the mixing disc.
Figure 5A:
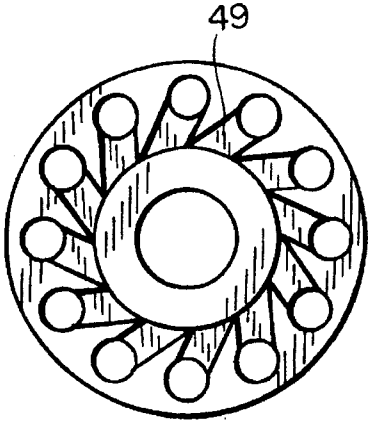
FIG. 5A is a frontal view of the mixing disc.

Turning now to FIGS. 5A, 5B and 5C, the mixing disc is depicted in front, back and cross-sectional views. Beginning with the center cross-section view (FIG. 5B), the mixing disc includes a central core. This core comprises the first inlet chamber 46 and a pintel lock opening 45. As can be seen with the assembly FIG. 3, the pintel is inserted into the first inlet chamber and slides into a locked position with its proximal end lock fitted into the pintel lock opening 45. The proximal end surface of the pintel 30 defines the inlet chamber 46 in communication with openings 42 to feed the second series of angled outlets 44. A concentric ring barrier 47 separates the inlet chamber 46 from the perimeter inlets 41. The inlets 41 feed the first angled outlets 43. Sets of outlets 43 and 44 alternatively form an array of outlets as shown in the left side of FIG. 5 and alternatively pass high pressure water and air into the mixing zone 48 to create the vortex two-phase stream.

Figure 6B:
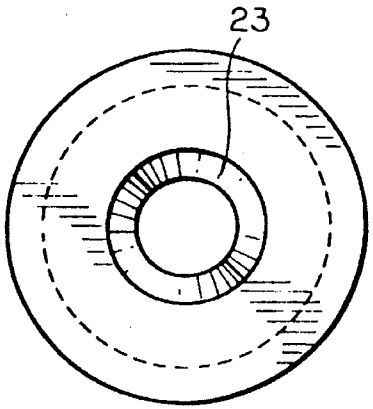
FIG. 6B is a frontal view of the nozzle housing.
Figure 6A:
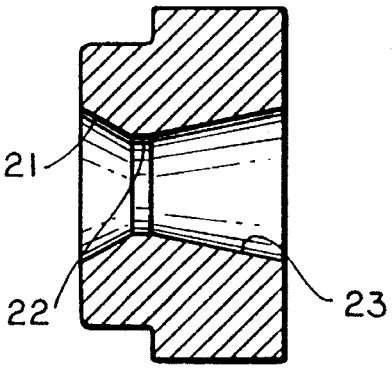
FIG. 6A is a cross-sectional view of the nozzle orifice.

Turning now to FIG. 6A, the orifice is shown in cross-sectional view, highlighting the constriction formed from the incline 23 to flat section 22 and finally expansion opening 21. The arrangement of the angled surfaces in the orifice provide for the acceleration of the water/gas from the mixing chamber to the impact plate on pintel 30. The angled surfaces (in the two dimensional figure) are actually conical surfaces (in 3D) as reflected in the end view (FIG. 6B). In this arrangement, the upstream side of the constriction is less steep than the down stream side, and both inclines are below 45°.

Figure 7:
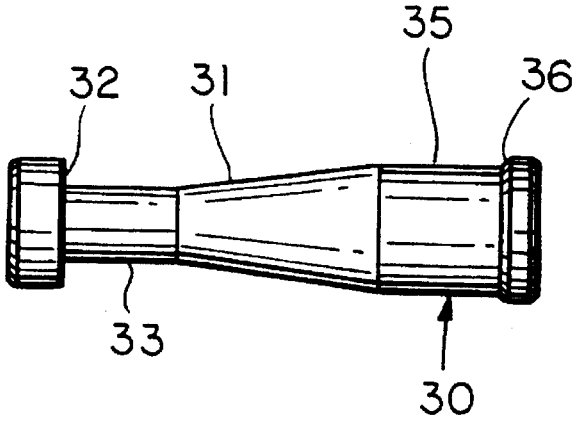
FIG. 7 is a cross-sectional view of the pintel.

The pintel is shown in FIG. 7, and comprises an elongated single piece structure having a proximal end for locking into the mixing disc 40 and a distal end with the impact plate 32. Pintel 30 has a first cylindrical portion 35 that snugly fits into mixing chamber 40 engaging locking rim 36 with lock opening 45. Inclined surface 31 has an angle less than 45°. Flat surface 33 terminates with the impact plate 32 at the distal end, with the flat surface positioned to correspond with the constriction in the orifice 20.

Figure 8A:
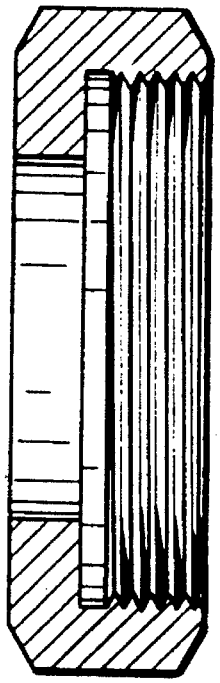
FIG. 8A is a cross-sectional view of the cap nut.
Figure 8B:
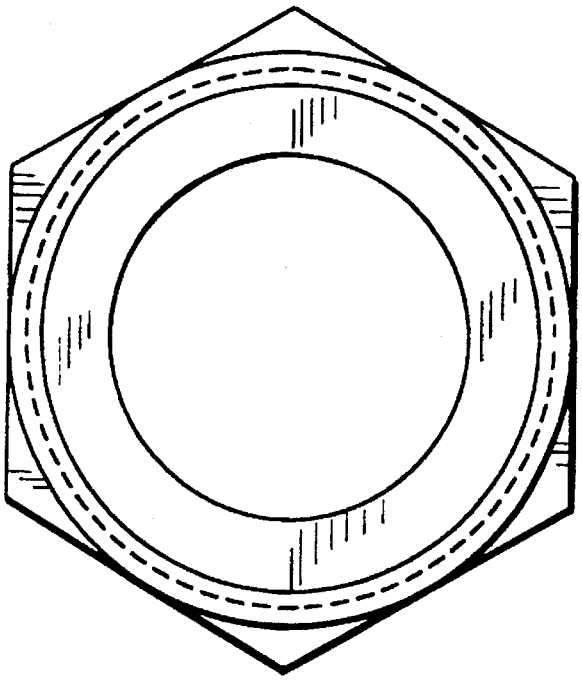
FIG. 8B is a back-end view of the cap nut.

The nozzle cap 10 is shown in FIGS. 8A and 8B and is constructed to thread onto nozzle housing 50 to provide a complete enclosure for the operative elements of the nozzle.

Having presented the preferred arrangement for the above nozzle invention, many modifications and adaptations thereof may be made without, however, departing from the spirit and scope of the present invention.

What is claimed is:

1. A nozzle for providing a high pressure stream of dispersed liquid droplets in a mist comprising:

an inlet means for receiving high pressure gas and liquid in two separate streams and configured to pass said separate streams into said nozzle;

a mixing means in communication with said inlet means for receiving said gas and liquid streams and directing said gas stream to a first series of outlets and said liquid stream to a second series of outlets, wherein said first and second series of outlets are arranged in an angled array exhausting into a first mixing chamber and said outlets concentrically alternate between gas and liquid outlet into said first mixing chamber;

a pintel means extending through said first mixing chamber and a second mixing chamber and terminating with an impact plate;

an orifice means in communication with said mixing means having an internal chamber defining said second mixing chamber, and further comprising a constriction zone in communication with said second mixing chamber, said constriction zone being downstream of said mixing means and upstream of said impact plate.

2. The nozzle of claim 1, further comprising a housing means for holding said nozzle including a nozzle housing inlet adaptor and a corresponding housing cap.

3. The nozzle of claim 1, wherein said angled array of outlets are concentrically arranged around a perimeter of said first mixing chamber.

4. The nozzle of claim 3, wherein said angled array of outlets are directed substantially perpendicular to said pintel.

5. The nozzle of claim 4, wherein said pintel has an anchor for fitting engagement with said mixing means.

6. The nozzle of claim 1, further comprising a symmetry between said gas and liquid angled array outlets wherein performance is independent of the inlet gas and liquid interconnection to the mixing means.

7. The nozzle of claim 1 wherein said angled array of outlets are set at an angle of approximately 25° from center.

8. The nozzle of claim 1 having twelve angled array outlets.

9. A method for creating a fine mist of liquid particles comprising the steps of:

providing a gas and liquid stream to a nozzle assembly at about the same line pressure;

applying the liquid stream to a first set of concentrically arrayed angled outlets that exhaust into a first mixing chamber;

applying the gas stream to a second set of concentrically arrayed angled outlets that exhaust into said first mixing chamber;

mixing said gas and liquid streams in said mixing chamber to form a two-phase liquid/gas stream;

after said mixing step, accelerating said two-phase stream through a constriction; and after said accelerating step, impacting said two-phase stream on said impact plate, creating said finely divided mist of liquid particles.

10. The method of claim 9 wherein the concentric arrayed angled outlets are alternating liquid and gas stream outlets.

11. The method of claim 10 wherein the nozzle assembly includes two inlets for receiving said gas and liquid streams.

12. The method of claim 11, wherein said first set of concentrically arrayed angled outlets are symmetrical and substantially equivalent in size to said second set of concentrically arrayed angled outlets.

13. A nozzle for intermixing liquid and gas to create a finely divided mist, comprising:

an inlet for receiving separate gas and liquid streams;

an angled array of distributed concentric fluid outlets directed towards a central mixing chamber;

a fluid constriction passage downstream of and in fluid communication with said mixing chamber; and an exhaust impact plate downstream of and in fluid communication with said fluid constriction passage.

14. The nozzle of claim 13, wherein said concentric fluid outlets are symmetrical and alternate as gas and liquid outlets into said mixing chamber.

* * * * *